US005124084A

United States Patent [19]

Eide

[11] Patent Number: 5,124,084

[45] Date of Patent: Jun. 23, 1992

[54] CARBURETOR DRAIN APPARATUS

[75] Inventor: Donn C. Eide, Thief River Falls, Minn.

[73] Assignee: Arctco, Inc., Thief River Falls, Minn.

[21] Appl. No.: 638,359

[22] Filed: Jan. 4, 1991

[51] Int. Cl.[5] ..... F02M 9/02

[52] U.S. Cl. ..... 261/4; 261/72.1; 261/44.3

[58] Field of Search ..... 261/44.3, 72.1, 4, 44.4

[56] References Cited

U.S. PATENT DOCUMENTS

| | | | |
|---|---|---|---|
| 1,208,196 | 12/1916 | Pembroke . | |
| 1,414,935 | 5/1922 | Cox et al. | 261/44.3 |
| 1,717,875 | 6/1929 | Chandler . | |
| 1,987,981 | 1/1935 | Tice . | |
| 2,046,884 | 7/1953 | Findley . | |
| 2,690,842 | 10/1954 | Spluvak . | |
| 2,790,458 | 4/1957 | Kalert . | |
| 3,550,776 | 12/1970 | Hamilton | 210/94 |
| 3,780,996 | 12/1973 | Nutten | 261/72.1 |
| 4,013,741 | 3/1977 | Edmonston | 261/44 |
| 4,044,080 | 8/1977 | Matsumoto et al. | 261/44 |
| 4,051,815 | 10/1977 | Coberley | 123/25 |
| 4,108,952 | 8/1978 | Iwao | 261/44.3 |
| 4,526,275 | 7/1985 | Nixon | 206/231 |
| 4,793,950 | 12/1988 | Hedlund | 261/4 |
| 4,913,855 | 4/1990 | Panzick | 261/72.1 |

FOREIGN PATENT DOCUMENTS 63-79457 5/1988 Japan .

*Primary Examiner*—Tim Miles

*Attorney, Agent, or Firm*—Merchant, Gould, Smith, Edell, Welter & Schmidt

[57] ABSTRACT

A carburetors drain apparatus, particularly suited for two stroke internal combustion engine applications. The drain apparatus diverts fuel contaminants away from the fuel jets to a remotely located sediment collector. The collector retains the accumulated contaminants until drained.

14 Claims, 1 Drawing Sheet

CARBURETOR DRAIN APPARATUS

FIELD OF THE INVENTION

The invention relates to carburetor drain apparatus, particularly suited for two-stroke internal combustion engine applications. The drain apparatus diverts fuel contaminants away from the fuel jet to a remote collector.

BACKGROUND OF THE INVENTION

Crank-case scavenged two-stroke engines are widely used in applications here high power to weight ratios are sought. It is common for crank case scavenged engines to mix lubricating oil with the fuel and to rely upon crank case turbulence during change induction to lubricate the engine bearings.

When multi-cylinder crank case scavenged engines are used for cold weather applications such as snowmobiles, lubrication problems can occur, if particulates are drawn into, and clog, the fuel jets.

It has been found that in cold weather, water within the fuel can condense and freeze within the fuel jet of the carburetor, thus blocking fuel delivery. This blockage can result in a lean mixture. Such lean mixtures cause the affected cylinder to run "hot" and also reduce cylinder wall and bearing lubrication.

This problem is particularly severe in snowmobiles where substantial amount of snow and ice often surround the induction portions of individual cylinders. In multiple cylinder configurations, all cylinders continue to move even if the fuel flow is obstructed to one of the cylinders. This may result in continued operation of the cylinder having a lean mixture results in substantial engine damage.

The prior art recognizes this problem. U.S. Pat. No. 4,793,950 to Hedlund, teaches the use of a flexible rubber collection tube located directly below the fuel jet to collect contaminants.

SUMMARY OF THE INVENTION

In contrast to the prior art structures, the present invention teaches the use of a diverter plug to divert fuel contaminants, including ice crystals, away from the fuel jets to a remote location for collection.

It is a principal object of the present invention to divert fuel contaminants away from the fuel jets to a remote location to prevent their obstruction of the jet orifice. The apparatus incorporates a substantially conical diverter plug which is located directly beneath the fuel jet to provide convenient access to the fuel jet. The plug provides convenient access to the fuel jet and needle structures, while directing contaminants away from the jet.

Because the diverter plug is located directly below the fuel jet, the gap between the fuel jet and the diverter plug can be precisely controlled. This gap permits ice formed within the jet to fall onto the plug and be directed away from the fuel jet entry, while still permitting adequate fuel flow. Although the application discloses a preferred and illustrative clearance gap of between 0.2 to 0.3 inches, the invention can accommodate variation in the clearance gap.

The float bowl floor is also configured to divert contaminants away from the fuel jet to a remote location for collection. The configuration of the float bowl floor can range from a simple slope to a complex curvilinear shape. The fuel contaminant collector is preferably located at the lowest point of the float bowl.

Another object of the present invention is to provide a collector with sufficient volume to retain a substantial quantity of fuel contaminants.

Another object of the present invention is to provide a convenient method for draining the contaminants from the collector.

Still another object of the present invention is to utilize gravity to retain the fuel contaminants in the collector by locating the collector at a lower level than the floor of the float bowl.

DETAILED DESCRIPTION OF THE PREFERRED EMBODIMENT

Figure 1:
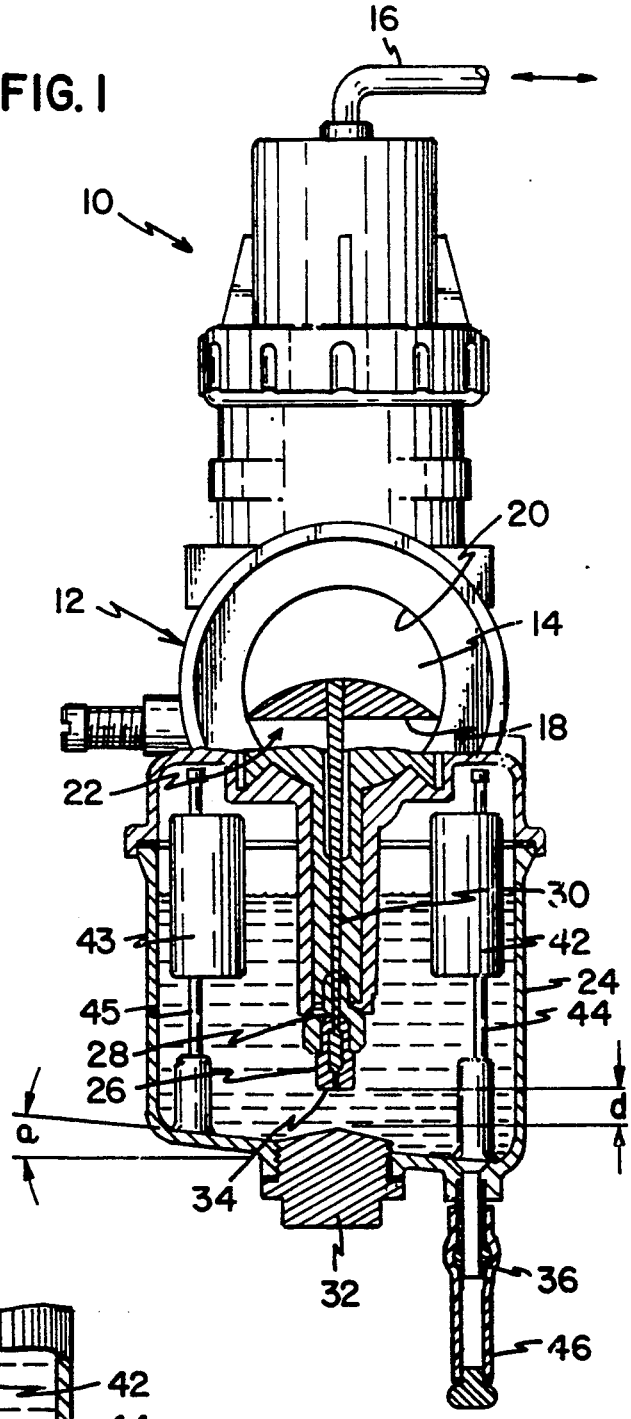
FIG. 1 is a front view of a carburetor incorporating the diverter plug and sediment trap of the present invention.
Figure 2:
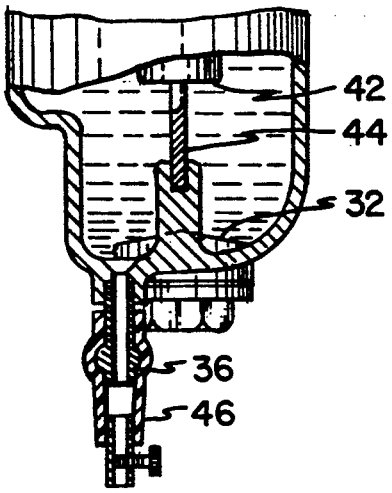
FIG. 2 is a side view of the carburetor and diverter plug and fuel trap apparatus.

The carburetor 10 includes a die cast body 12. A throttle slide 14 is positioned within the body. The throttle slide is activated by a throttle cable 16. The lower surface of the throttle slide 18 cooperates with the throttle bore 20 formed within the body 12 to form a venturi area 22.

Air flow through the venturi draws fuel from the float bowl 24 through a jet 26. A metering aperture 28 is formed by the throttle needle 30 and the walls of the jet 26. In general, the taper of the needle is selected to provide the appropriate mixture at all throttle positions.

Some combinations of fuel moisture and atmospheric conditions result in temperatures well below freezing within the throttle bore. Although carburetor icing per se is not detrimental to the engine, if ice crystals form in the vicinity of the jet and needle, the ice crystals may obstruct the passage of fuel from the bowl 24 into the throttle venturi 22. Other fuel contaminants also collect in the bowl 24 and can be drawn into the jet 26. Blockage of the jet 26 results in a lean fuel mixture, resulting in the loss of the lubrication.

As previously described, this problem is especially acute in multi-cylinder snowmobile engines, where all cylinders are mechanically coupled. This mechanical coupling means that all the cylinders continue to operate at high speeds, even when the fuel flow is obstructed in an individual carburetor. Continued operation when the mixture being received by the cylinder is very lean results in inadequate lubrication and accelerating wear.

It has been found that these conditions can be eliminated by providing a conically pointed diverter plug 32 directly below the jet 26. The space between the tip of the diverter plug and the jet should be quite small, on the order of 0.25 inches.

Experimentation has determined that this clearance does not reduce fuel flow and provides sufficient space to prevent ice or other large contaminants from obstructing the jet, and to permit these contaminants to escape back into the float bowl 24. It should be noted that the gap between the jet 26 and the diverter plug 32 can be adjusted to compensate for environmental and weather conditions, fuel mixtures and other related factors.

The edges of the plug are inclined at an angle of 10°. Ice crystals or other contaminants coming in contact with the plug are diverted away from the jet entry 34. A drain connection 36 is provided at the low part of the bowl through which the sediment passes. A flexible drain connection 46 is attached to the drain connection 36 to collect the sediment.

Although there may be a generous range of operable values for the diverter plug and float bowl inclination, it has been found that an included angle of 10° for the diverter plug coupled with a plug to jet clearance of 0.25 inches, in combination with a 5° tilt of the float bowl toward the drain, results in reliable operation even in the presence of moisture in the fuel and operating environment. The relationship between these three variables may change if a curvilinear float bowl floor configuration is adopted.

Finally, as fuel is admitted through fuel entry 34 of jet 26, the fuel level in the float chamber 24 drops until floats 42 and 43 drop sufficiently to open float check valve 38, permitting additional fuel to enter the float bowl 24 through conduit 40.

Although particular embodiments of the invention have been illustrated in the accompanying drawing and described in the detailed description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. Carburetor drain apparatus for diverting fuel contaminants away from the fuel jet into a remote trap, comprising:

a float bowl for providing fuel to the fuel jet of the carburetor, said float bowl having a floor which slopes, said floor having its lowest point substantially remote from the fuel jet inlet area;

a diverter plug located in said floor of said float bowl located proximate the fuel jet, said diverter plug having an upper surface which slopes to divert fuel contaminants away from the fuel jet;

collection trap means located proximate said lowest point of said float bowl floor, for receiving said fuel contaminants, said collection trap means having sufficient volume to retain said fuel contaminants.

2. Tho carburetor drain apparatus of claim 1 wherein said float bowl floor has a curvilinear shape.

3. The carburetor drain apparatus of claim 1, wherein said collection trap means comprises an elongated tube attached at the first end to the float bowl, the tube extending below the float bowl and terminating at a second end.

4. The carburetor drain apparatus of claim 3 wherein the elongated tube is made of an elastic material.

5. The carburetor drain apparatus of claim 3 wherein the elongated tube is flexible.

6. The carburetor drain apparatus of claim 1 wherein said collection means includes drain means for removing the fuel contaminants from said collection means.

7. The carburetor drain apparatus of claim 6 wherein said drain means attached to the second end of said elongated tube is a valve.

8. The carburetor drain apparatus of claims 6 wherein said second end of said elongated tube terminates in a removable plug.

9. The carburetor drain apparatus of claim 8 wherein the drain means is a plug held into the second end of the elongated tube by friction.

10. The carburetor drain apparatus of claim 1 wherein the float bowl vibrates during carburetor operation to convey fuel contaminants to the lowest point of said float bowl.

11. The carburetor drain apparatus of claim 1 wherein the upper surface of said diverter plug has a curvilinear shape.

12. The carburetor drain apparatus of claim 1 wherein a variety of clearance gaps are possible between said diverter plug and the carburetor fuel jet.

13. The carburetor drain apparatus of claim 1 wherein said diverter plug has a clearance gap from the carburetor fuel jet of between 0.2 and 0.3 inches.

14. In a carburetor, a carburetor drain apparatus for diverting sedimentary fuel contaminants away from the fuel jet inlet area, into a collection means, comprising:

a float bowl for providing fuel to the fuel jet of the carburetor, said float bowl having a floor which slopes, said floor having its lowest point substantially remote from the fuel jet inlet area;

a diverter plug in the floor of said float bowl located substantially near the fuel jet inlet area, the upper surface of said diverter plug which slopes so that its lowest point is remote of the fuel jet inlet area;

a collection means at the lowest point of said float bowl floor, said collection means having sufficient volume to retain said sedimentary fuel contaminants.

* * * * *